US011499805B2

(12) United States Patent
Oberholzer

(10) Patent No.: US 11,499,805 B2
(45) Date of Patent: Nov. 15, 2022

(54) ELECTRIC SHOCK AMMUNITION ROUND

(71) Applicant: Hemi Holdings LLC, Missouri City, TX (US)

(72) Inventor: Barend Hendrik Oberholzer, Los Angeles, CA (US)

(73) Assignee: HEMI HOLDINGS LLC, Missouri City, TX (US)

( * ) Notice: Subject to any disclaimer, the term of this patent is extended or adjusted under 35 U.S.C. 154(b) by 0 days.

(21) Appl. No.: 17/720,829

(22) Filed: Apr. 14, 2022

(65) Prior Publication Data

US 2022/0333905 A1 Oct. 20, 2022

Related U.S. Application Data

(60) Provisional application No. 63/174,980, filed on Apr. 14, 2021.

(51) Int. Cl.
*F41H 13/00* (2006.01)

(52) U.S. Cl.
CPC ..... *F41H 13/0031* (2013.01)

(58) Field of Classification Search
CPC ..... F41H 13/0031
See application file for complete search history.

(56) References Cited

U.S. PATENT DOCUMENTS 4,872,084 A * 10/1989 Dunning ..... H05C 1/04 231/7
5,698,815 A * 12/1997 Ragner ..... F41H 13/0006 102/504
6,862,994 B2 3/2005 Chang
7,096,792 B1 8/2006 Carman
7,421,951 B2 * 9/2008 Genis ..... F42B 12/54 361/232
7,444,939 B2 11/2008 McNulty
7,856,929 B2 * 12/2010 Gavin ..... F41H 13/0025 361/232
7,984,676 B1 * 7/2011 Gavin ..... F42B 5/073 361/232
7,986,506 B2 * 7/2011 Brundula ..... F41H 13/0031 361/232
8,261,666 B2 * 9/2012 Garg ..... F42B 12/36 361/232
8,701,325 B1 * 4/2014 Rayner ..... F42B 12/50 42/105
9,618,303 B2 * 4/2017 Hensler ..... F41H 13/0031
10,101,135 B1 10/2018 Abboud
10,996,039 B1 * 5/2021 DeLuca ..... F42C 11/06
2010/0275806 A1 11/2010 Gavin et al.
2012/0298006 A1 11/2012 Garg
2014/0334058 A1 11/2014 Galvin et al.
2020/0116465 A1 4/2020 Hucker et al.

* cited by examiner

*Primary Examiner* — Joshua T Semick

(57) ABSTRACT

An electric shock round utilized in projectile launching systems suitable for ranged non-lethal applications is presented. The electric shock round contains a projectile housing, a nose cap, an electroshock generation unit, and a plurality of electrodes. The electroshock generation unit is connected within the projectile housing. The plurality of electrodes is connected to the electroshock generation unit, opposite to the projectile housing. The nose cap is connected adjacent to the projectile housing, where the nose cap houses and secures the plurality of electrodes.

9 Claims, 8 Drawing Sheets

ELECTRIC SHOCK AMMUNITION ROUND

FIELD OF THE INVENTION

The present invention generally relates to the field of non-lethal and less-than-lethal ballistic artifacts and related matter. More specifically, an electric charge discharging ammunition round where the charge is delivered via a modified composite projectile, or an industry standard bullet fired from existing industry standard weapons.

BACKGROUND OF THE INVENTION

Electric shock non-lethal and less-than-lethal ballistic artifacts are commonly used in law enforcement, military, anti-terrorism and homeland security initiatives. However, most electric shock ballistic artifacts are limited by the effective range, such as taser guns. Additionally, the development of custom electric shock ammunition rounds usually also involves a custom firearm or similar.

The present invention aims to provide an electric shock ammunition round which is compatible with industry standard firearms. Therefore, the internal components of the present invention remain the same, but the outer shell varies depending on the firearm, accordingly.

Furthermore, the present invention does not require an external source of power to charge or maintain the charge in the magazine or ammunition. The charge is activated the moment a bullet is fired from the weapon. The preferred components and arrangement are disclosed in the present document along with the accompanying figures.

The following document aims to provide an accurate and detailed description of the present invention without limiting the scope of the invention, and the accompanying figures are only intended to help illustrate the present invention. Thus, the accompanying figures do not limit the scope of the invention in any way, shape or form.

SUMMARY OF THE INVENTION

The present invention is an electric shock round utilized in projectile launching systems suitable for ranged non-lethal applications. The electric shock round comprises a projectile housing, a nose cap, an electroshock generation unit, and a plurality of electrodes. The projectile housing comprises an electronics receiving cavity, a cap receiving end, and a stabilizing end. The electroshock generation unit comprises a power source, a generator, a transformer, a voltage multiplier, and a triggering element. The cap receiving end and the stabilizing end is terminally positioned opposite to each other along the projectile housing. The electronics receiving cavity traversing from the cap receiving end to the stabilizing end. The electroshock generation unit is connected within the electronics receiving cavity. The power source is electrically connected to the generator. The generator is electronically connected to the transformer. The transformer is electronically connected to the voltage multiplier. The voltage multiplier is electronically connected to the triggering element. The triggering element is electrically connected to the plurality of electrodes.

DETAIL DESCRIPTIONS OF THE INVENTION

Figure 1:
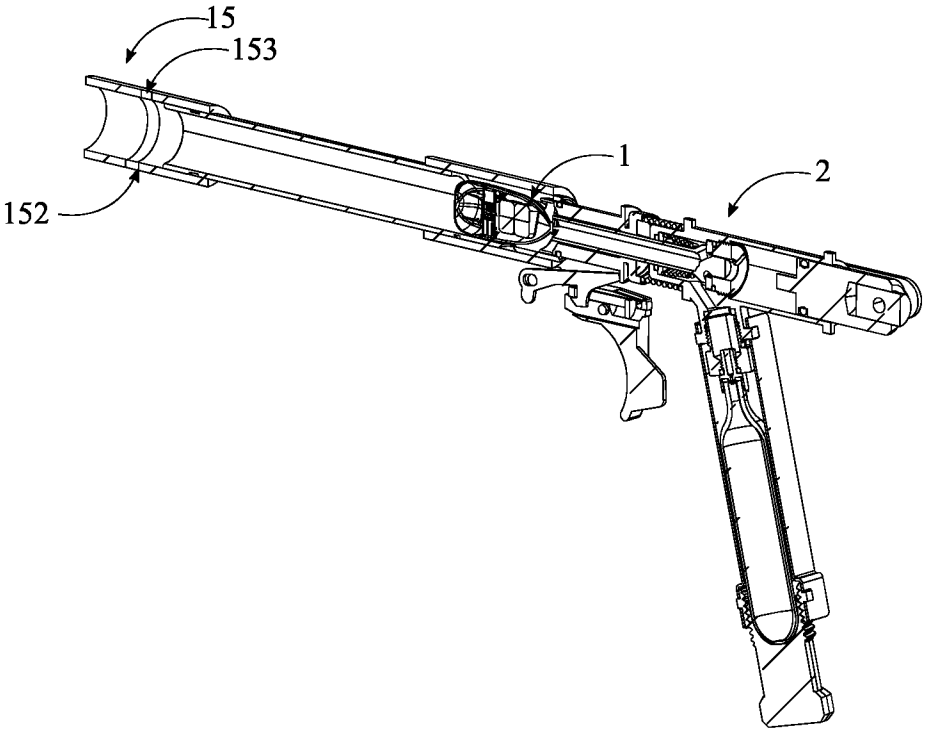
FIG. 1 is a cutaway perspective view showing the present invention loaded in a projectile launching system.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIGS. 1-7, the present invention is an electric shock round 1 utilized in projectile launching systems 2 suitable for ranged non-lethal applications. The electric shock round 1 comprises a projectile housing 11, a nose cap 12, an electroshock generation unit 13, and a plurality of electrodes 14. The projectile housing 11 comprises an electronics receiving cavity 111, a cap receiving end 112, and a stabilizing end 113. The electroshock generation unit 13 comprises a power source 131, a generator 132, a transformer 133, a voltage multiplier 134, and a triggering element 135. The cap receiving end 112 and the stabilizing end 113 is terminally positioned opposite to each other along the projectile housing 11. The electronics receiving cavity 111 traversing from the cap receiving end 112 to the stabilizing end 113. The electroshock generation unit 13 is connected within the electronics receiving cavity 111. The power source 131 is electrically connected to the generator 132. The generator 132 is electronically connected to the transformer 133. The transformer 133 is electronically connected to the voltage multiplier 134. The voltage multiplier 134 is electronically connected to the triggering element 135. The triggering element 135 is electrically connected to the plurality of electrodes 14.

In reference to FIGS. 5-8, the plurality of electrodes 14 is connected adjacent to the electroshock generation unit 13, opposite to the projectile housing 11. In the preferred embodiment, the projectile housing 11 takes the form of any suitable protective shell that secures and protects the electroshock generation unit 13 from temperature, pressure, and impact variables when the electric shock round 1 is propelled through any suitable projectile launching system. In the preferred embodiment, the projectile housing 11 is made out of any suitable and durable material suitable for ballistic applications, such as, but not limited to polymer, aluminum, fiberglass, carbon fiber, or any other suitable material. In the preferred embodiment, the nose cap 12 takes the form of any suitable ballistic projectile tip that secures and encloses the electroshock generation unit 13 within the projectile housing 11. In the preferred embodiment, the nose cap 12 is shaped to any form to optimize ballistic stability, aerodynamics, or mechanical feeding operations for semi or fully automatic projectile launching systems 2. In the preferred embodiment, the electroshock generation unit 13 serves as the main unit to administer electroshock energy to the targeted area. The plurality of electrodes 14 takes the form of any suitable electrical transmission element that transfers electroshock energy from the electroshock generation unit 13 to the targeted area.

In reference to FIGS. 5-8, the electronics receiving cavity 111 secures the electroshock generation unit 13 within the projectile housing 11. The cap receiving end 112 receives and secures the nose cap 12. The stabilizing end 113 takes the form of the base of the projectile housing 11 that facilitates further stabilizing implements, such as, but not limited to fins, tails, drag-inducing stabilizing elements, or any other suitable stabilizing implement.

In reference to FIGS. 5-8, the power source 131 takes the form of any suitable power source 131, such as, but not limited to high discharge rate batteries, super capacitors, or any other suitable power source 131 sufficient in providing ample power for the electroshock generation unit 13. In the preferred embodiment, the generator 132 takes the form of any suitable voltage generating unit in creating a high-frequency alternating voltage derived from the power source 131. In the preferred embodiment, the transformer 133 further increases the voltage derived from the generator 132. In the preferred embodiment, the voltage multiplier 134 takes the form of any suitable capacitor and diode electronic scheme that converts the increased voltage outputted by the transformer 133 to a higher voltage. Additionally, the voltage multiplier 134 retains the higher voltage charge. In the preferred embodiment, the triggering element 135 serves as the main discharging element of the electroshock generation element. More specifically, the triggering element 135 takes the form of a spark gap or a micro-controller managed transistor.

In reference to FIGS. 1-3, and 6-8, the electric shock round 1 further comprises an activation element 15. The activation element 15 is electronically engaged to the electroshock generation unit 13, where the activation element 15 is configured to activate the triggering element 135 to an activated configuration. In the preferred embodiment, the activation element 15 takes the form of any suitable activation means, such as, but not limited to magnetic activation, inertia activation, timer activation means, or any other suitable activation means. In the preferred embodiment, the activation element 15 serves as a safety factor, preventing the electric shock round 1 from discharging prematurely.

Figure 5:
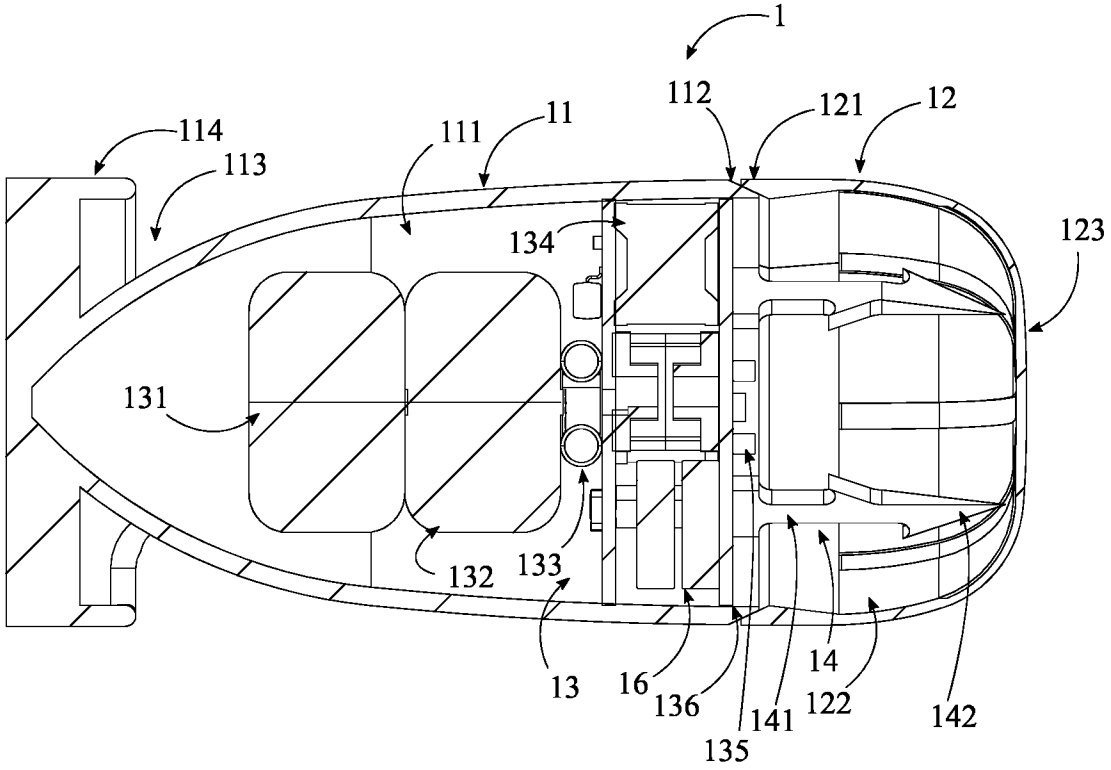
FIG. 5 is cross sectional view of the present invention taken along cutting lines A-A in FIG. 4.
Figure 6:
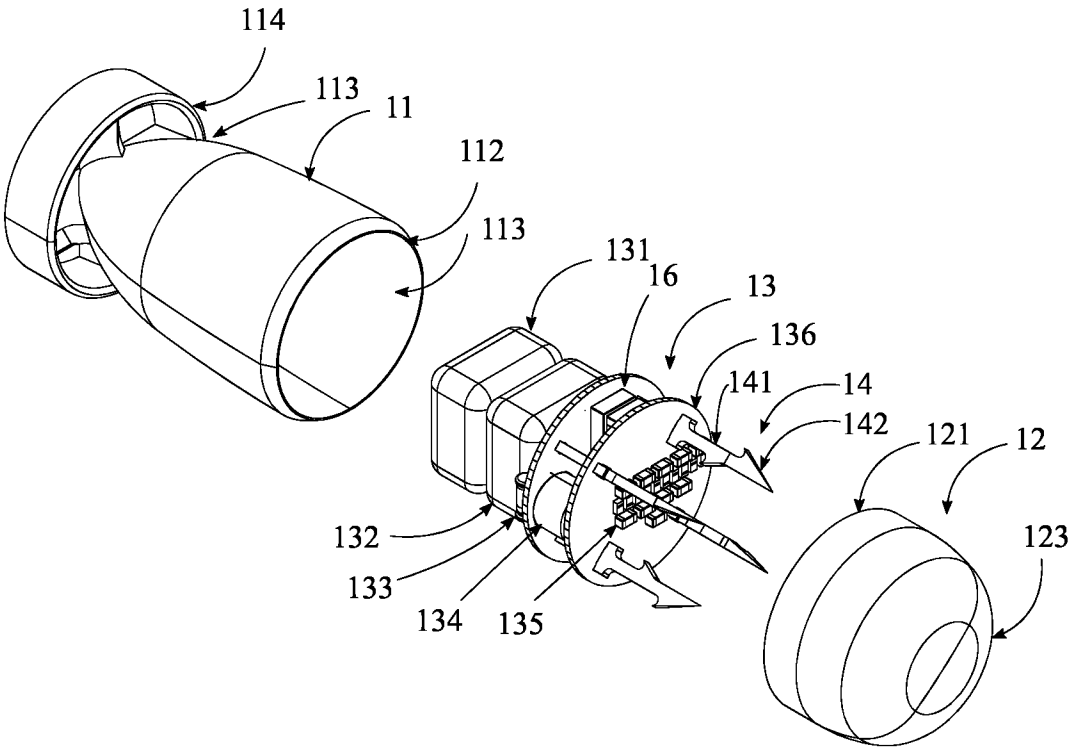
FIG. 6 is a perspective exploded view of the present invention.
Figure 7:
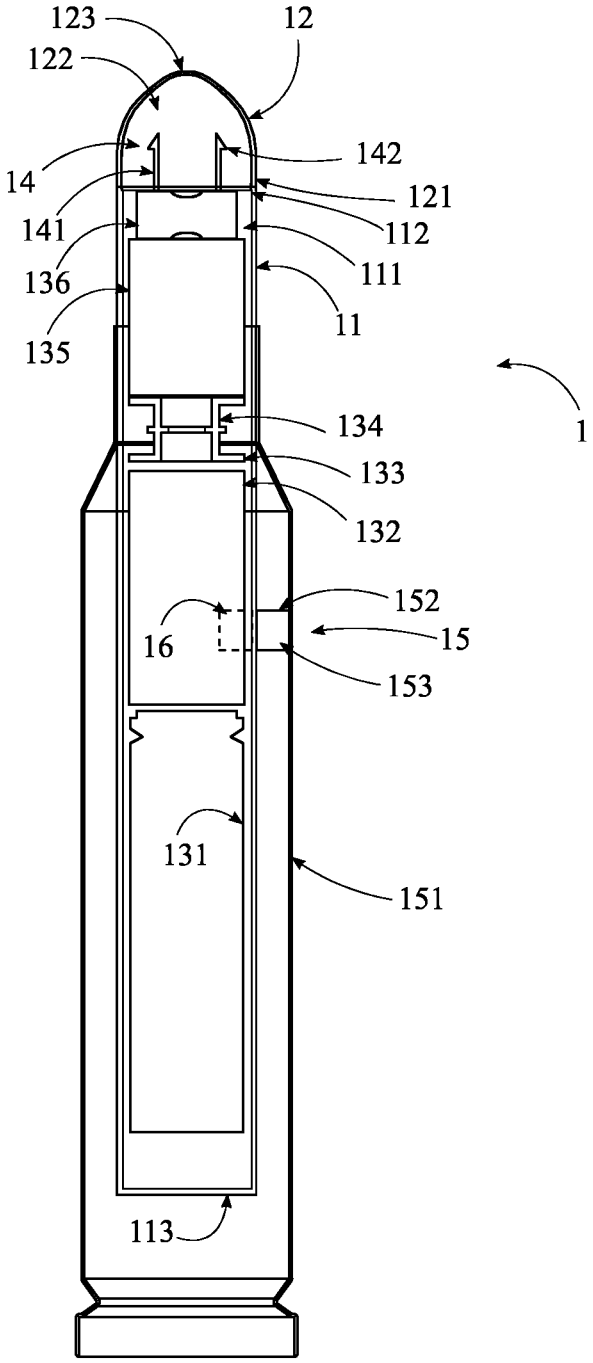
FIG. 7 is a diagram view of the present invention in accordance with another embodiment.
Figure 8:
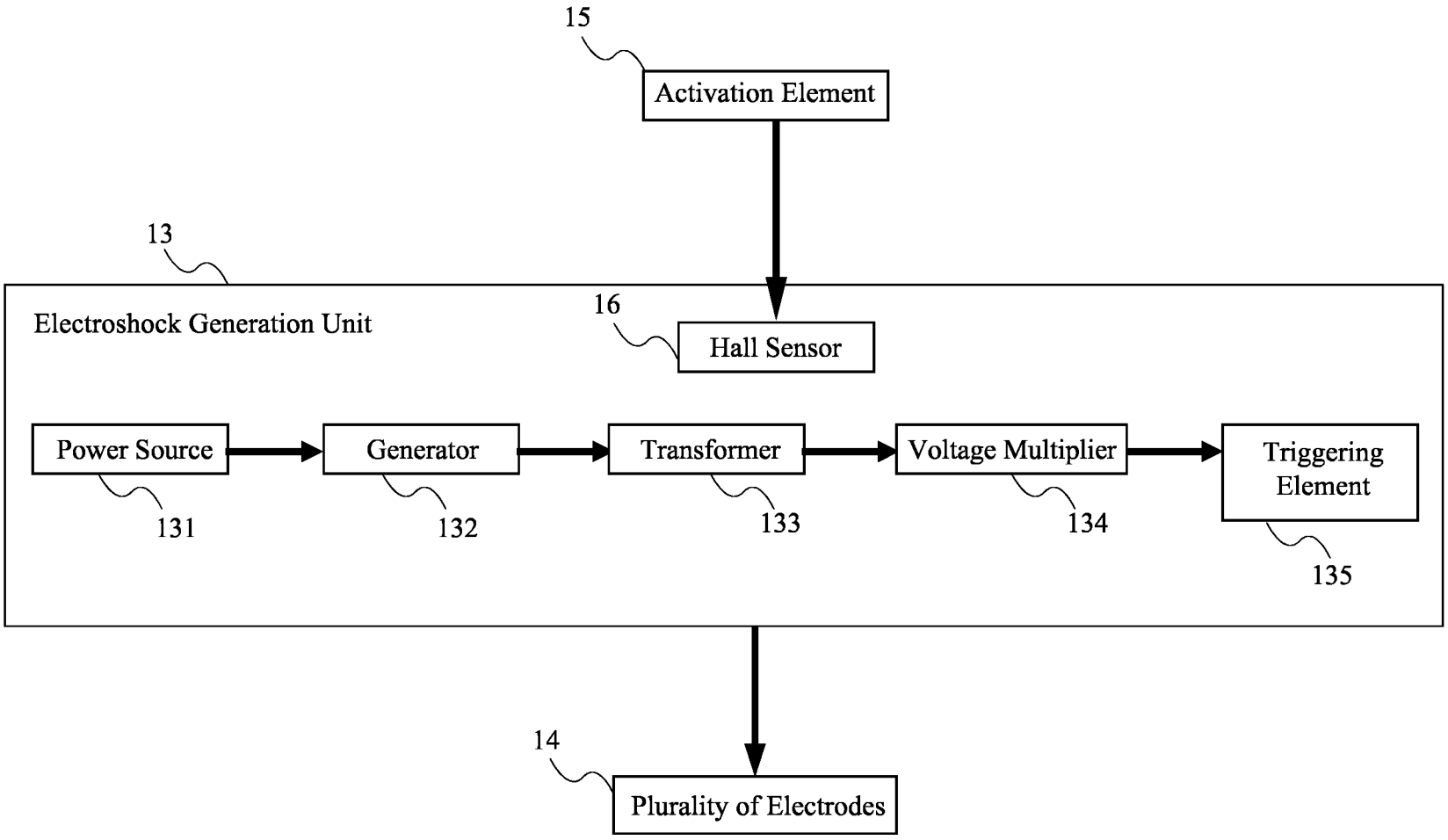
FIG. 8 is a circuit diagram used in the present invention.

In reference to FIGS. 5-7, the plurality of electrodes 14 comprises a pin body 141 and a barbed tip 142. The pin body 141 and the barbed tip 142 is electrically connected to the electroshock generation unit 13. The pin body 141 is connected adjacent to the electroshock generation unit 13, opposite to the projectile housing 11. The barbed tip 142 is connected adjacent to the pin body 141, opposite to the electroshock generation unit 13. The projectile housing 11 further comprises a stabilizing element 114. The stabilizing element 114 is connected adjacent to the stabilizing end 113. In the preferred embodiment, the pin body 141 projects the barbed tip 142 from the electroshock generation unit 13. In the preferred embodiment, the barbed tip 142 allows the electroshock generation unit 13 to penetrate and grasp along clothing, skin, or any other insulative layer featured on the targeted area in order to administer electroshock incapacitation to the target. In the preferred embodiment, the plurality of electrodes 14 is made out of any suitable material, such as, but not limited to copper alloy, steel, aluminum, or any other suitable material. In the preferred embodiment, the stabilizing element 114 takes the form of any suitable stabilizing implement that stabilizes the electric shock round 1 during flight such that nose cap 12 is oriented forward. In the preferred embodiment, the stabilizing element 114 may take the form of a stabilizing weight derived from the mass of the power source 131 but can take the form of any other suitable stabilizing implement, such as, but not limited to tails, fins, shuttlecocks, or any other stabilizing element 114.

In reference to FIGS. 4-7, the nose cap 12 comprises a cap connecting end 121, a cap cavity 122, and a nose tip 123. The cap connecting end 121 and the nose tip 123 are positioned terminally opposite to each other along the nose cap 12. The cap cavity 122 traversing from the cap connecting end 121 to the nose tip 123. The cap connecting end 121 is connected adjacent to the cap receiving end 112. The plurality of electrodes 14 is positioned within the cap cavity 122. In the preferred embodiment, the nose cap 12 is made out of an elastomeric material. In the preferred embodiment, the cap connecting end 121 secures along the cap receiving end 112 of the projectile body through any fastening means, such as, but not limited to adhesives, threads, or any other suitable fastening implement. In the preferred embodiment, the plurality of electrodes 14 is housed and secured within the cap cavity 122, where the nose cap 12 is configured to collapse when the nose cap 12 comes into contact with the targeted area, and where the plurality of electrodes 14 is configured to penetrate through the nose tip 123.

In reference to FIGS. 5-8, the power source 131 is terminally connected adjacent to the generator 132. The generator 132 is connected between the transformer 133 and the generator 132. The transformer 133 is connected adjacent to the generator 132, opposite to the battery. The voltage multiplier 134 is connected adjacent to the transformer 133, opposite to the generator 132. The triggering element 135 is terminally connected to the voltage multiplier 134. The electroshock generation unit 13 comprises a plurality of surge arresters 136 and the plurality of surge arresters 136 is electrically connected to the voltage multiplier 134. In the preferred embodiment, the plurality of surge arresters 136 takes the form of surge protection elements that protects the electrical and electronic components that constitutes the electroshock generation unit 13.

Figure 2:
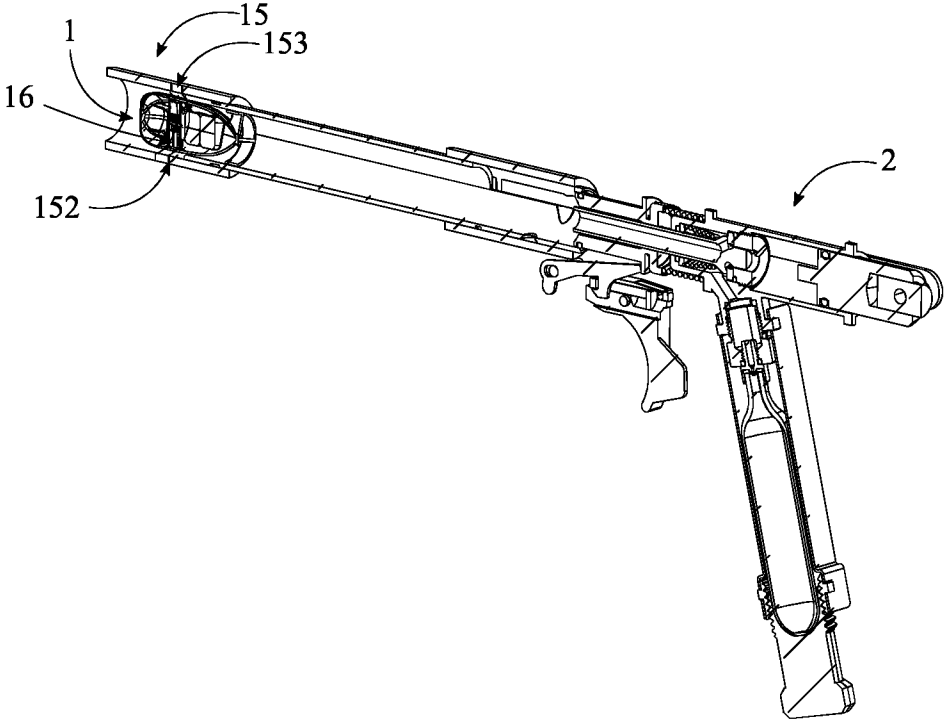
FIG. 2 is a cutaway perspective view showing the present invention fired from the projectile launching system, where the present invention is activated by a muzzle mounted activation element.
Figure 3:
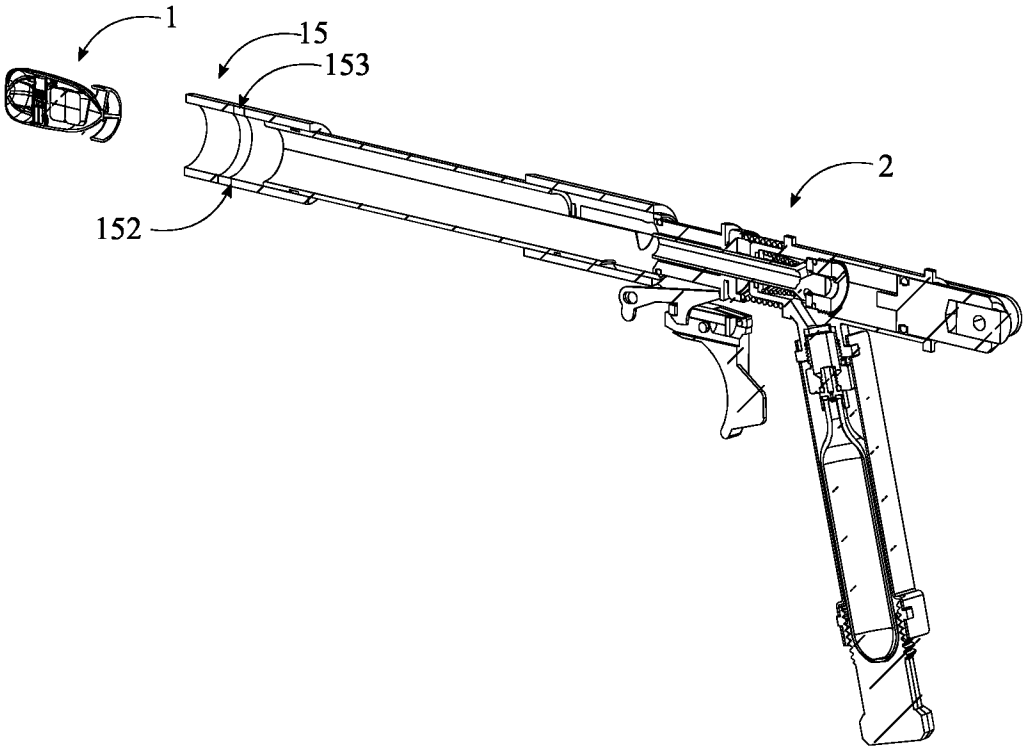
FIG. 3 is a cutaway perspective view showing the present invention fired from the projectile launching system, where the activated present invention leaves the muzzle of the projectile launching system.
Figure 4:
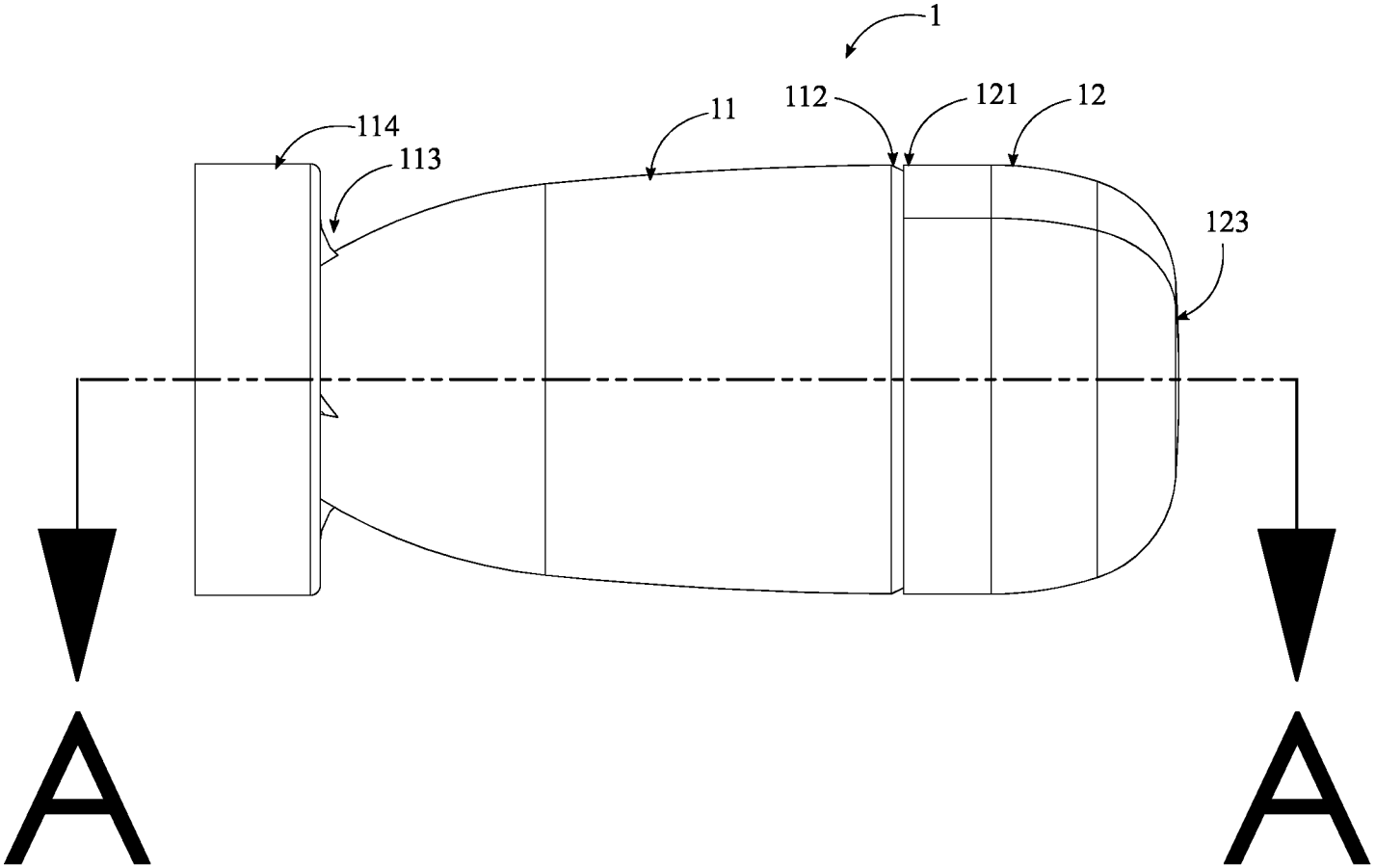
FIG. 4 is a side view of the present invention.

In one embodiment, the activation element 15 is a muzzle device that comprises a magnet insert 153 and a magnet receiver 152, as shown in FIGS. 1-3. The electric shock round 1 further comprises a hall sensor 16. The magnet receiver 152 is positioned within the muzzle device. The magnet insert 153 is connected within the magnet receiver 152. The hall sensor 16 is electronically connected to the electroshock generation unit 13. The hall sensor 16 is selectively engaged to the magnet insert 153, where the hall sensor 16 is configured to electrically activate the electroshock generation unit 13 when the hall sensor 16 comes into contact with the magnet insert 153. In this embodiment, the muzzle device is attached onto projectile launching systems 2 that utilize propulsion systems generated by the projectile launching system, such as, but not limited to air guns, paintball markers, pneumatic rifles, pneumatic handguns, coil guns, or any other suitable projectile launching system.

In a second embodiment, the activation element 15 is a firearm casing that comprises a casing body 151, the magnet receiver 152, and the magnet insert 153, as shown in FIG. 7. The magnet receiver 152 traversing into the casing body 151. The hall sensor 16 is connected along the electroshock generation unit 13. The magnet receiver 152 is positioned along the hall sensor 16. The magnet insert 153 is connected within the magnet receiver 152. The hall sensor 16 is electronically connected to the electroshock generation unit 13. The hall sensor 16 is selectively engaged to the magnet insert 153, where the hall sensor 16 is configured to electrically activate the electroshock generation unit 13 when the hall sensor 16 is displaced from the magnet insert 153. In this embodiment, the activation element 15 is outfitted to a firearm casing, where the firearm casing propels the electric shock round 1 through a customized primer and propellent charge catered to propel and activate the electric shock round 1 at a desired velocity.

Although the invention has been explained in relation to its preferred embodiment, it is to be understood that many other possible modifications and variations can be made without departing from the spirit and scope of the invention as hereinafter claimed.

What is claimed is:

1. An electric shock round comprising:

a projectile housing;

a nose cap;

an electroshock generation unit;

a plurality of electrodes;

the projectile housing comprising an electronics receiving cavity, a cap receiving end, and a stabilizing end;

the electroshock generation unit comprising a power source, a generator, a transformer, a voltage multiplier, and a triggering element;

the cap receiving end and the stabilizing end being terminally positioned opposite to each other along the projectile housing;

the electronics receiving cavity traversing from the cap receiving end to the stabilizing end;

the electroshock generation unit being connected within the electronics receiving cavity;

the power source being electrically connected to the generator;

the generator being electronically connected to the transformer;

the transformer being electronically connected to the voltage multiplier;

the voltage multiplier being electronically connected to the triggering element;

the triggering element being electrically connected to the plurality of electrodes;

the plurality of electrodes being connected adjacent to the electroshock generation unit, opposite to the projectile housing;

the nose cap comprising a cap connecting end, a cap cavity, and a nose tip;

the cap connecting end and the nose tip being positioned terminally opposite to each other along the nose cap;

the cap cavity traversing from the cap connecting end to the nose tip;

the cap connecting end being connected adjacent to the cap receiving end; and the plurality of electrodes being positioned within the cap cavity.

2. The electric shock round as claimed in claim 1 comprising:

an activation element; and the activation element being electronically engaged to the electroshock generation unit, wherein the activation element is configured to activate the triggering element to an activated configuration.

3. The electric shock round as claimed in claim 1 comprising:

the plurality of electrodes comprising a pin body and a barbed tip;

the pin body and the barbed tip being electrically connected to the electroshock generation unit;

the pin body being connected adjacent to the electroshock generation unit, opposite to the projectile housing; and the barbed tip being connected adjacent to the pin body, opposite to the electroshock generation unit.

4. The electric shock round as claimed in claim 1 comprising:

the projectile housing further comprising a stabilizing element; and the stabilizing element being connected adjacent to the stabilizing end.

5. The electric shock round as claimed in claim 1 comprising:

the power source being terminally connected adjacent to the generator;

the generator being connected between the transformer and the power source;

the transformer being connected adjacent to the generator, opposite to the battery;

the voltage multiplier being connected adjacent to the transformer, opposite to the generator; and the triggering element being terminally connected to the voltage multiplier.

6. The electric shock round as claimed in claim 1 comprising:

the electroshock generation unit comprising a plurality of surge arresters; and the plurality of surge arresters being electrically connected to the voltage multiplier.

7. The electric shock round as claimed in claim 2 comprising:

the activation element is a muzzle device comprising a magnet insert and a magnet receiver;

a hall sensor;

the magnet receiver being positioned within the muzzle device;

the magnet insert being connected within the magnet receiver;

the hall sensor being electronically connected to the electroshock generation unit; and the hall sensor being selectively engaged to the magnet insert, wherein the hall sensor is configured to electrically activate the electroshock generation unit when the hall sensor comes into contact with the magnet insert.

8. The electric shock round as claimed in claim 2 comprising:

the activation element is a firearm casing comprising a casing body, a magnet receiver, and a magnet insert;

a hall sensor;

the magnet receiver traversing into the casing body;

the hall sensor being connected along the electroshock generation unit;

the magnet receiver being positioned along the hall sensor;

the magnet insert being connected within the magnet receiver;

the hall sensor being electronically connected to the electroshock generation unit; and the hall sensor being selectively engaged to the magnet insert, wherein the hall sensor is configured to electrically activate the electroshock generation unit when the hall sensor is displaced from the magnet insert.

9. The electric shock round as claimed in claim 1, wherein the nose cap is made out of an elastomeric material.

* * * * *